United States Patent [19]

Hodge et al.

[11] 4,080,201

[45] Mar. 21, 1978

[54] NICKEL-BASE ALLOYS

[75] Inventors: Frank G. Hodge, Kokomo; Russell W. Kirchner, Greentown; William L. Silence, Kokomo, all of Ind.

[73] Assignee: Cabot Corporation, Kokomo, Ind.

[21] Appl. No.: 696,387

[22] Filed: Jun. 15, 1976

Related U.S. Application Data

[63] Continuation of Ser. No. 329,974, Feb. 6, 1973, abandoned.

[51] Int. Cl.[2] ..... C22C 19/05

[52] U.S. Cl. ..... 75/171; 148/32; 148/32.5; 148/162

[58] Field of Search ..... 75/171, 170; 148/32, 148/32.5, 162

[56] References Cited

U.S. PATENT DOCUMENTS

| | | | |
|---|---|---|---|
| 3,203,792 | 8/1965 | Scheil et al. | 75/171 |
| 3,510,294 | 5/1970 | Bieber et al. | 75/171 |
| 3,617,261 | 11/1971 | Lherbier et al. | 75/171 |

*Primary Examiner*—R. Dean

*Attorney, Agent, or Firm*—Jack Schuman; Joseph J. Phillips

[57] ABSTRACT

A nickel-base alloy is provided having excellent corrosion resistance to both oxidizing and reducing environments in all of the annealed, welded and thermally aged conditions. The alloy has the broad composition:

| | |
|---|---|
| Chromium | 12–18 |
| Molybdenum | 10–18 |
| Iron | 0–3 |
| Tungsten | 0–7 |
| Aluminum | <0.5 |
| Carbon | 0.02 max. |
| Silicon | 0.08 max. |
| Cobalt | <2 |
| Manganese | <0.5 |
| One of the group Titanium, Vanadium, Zirconium, Tantalum and Hafnium | up to 0.75 |
| Nickel and incidental impurities | Balance |

12 Claims, 7 Drawing Figures

NICKEL-BASE ALLOYS

Figure 1:
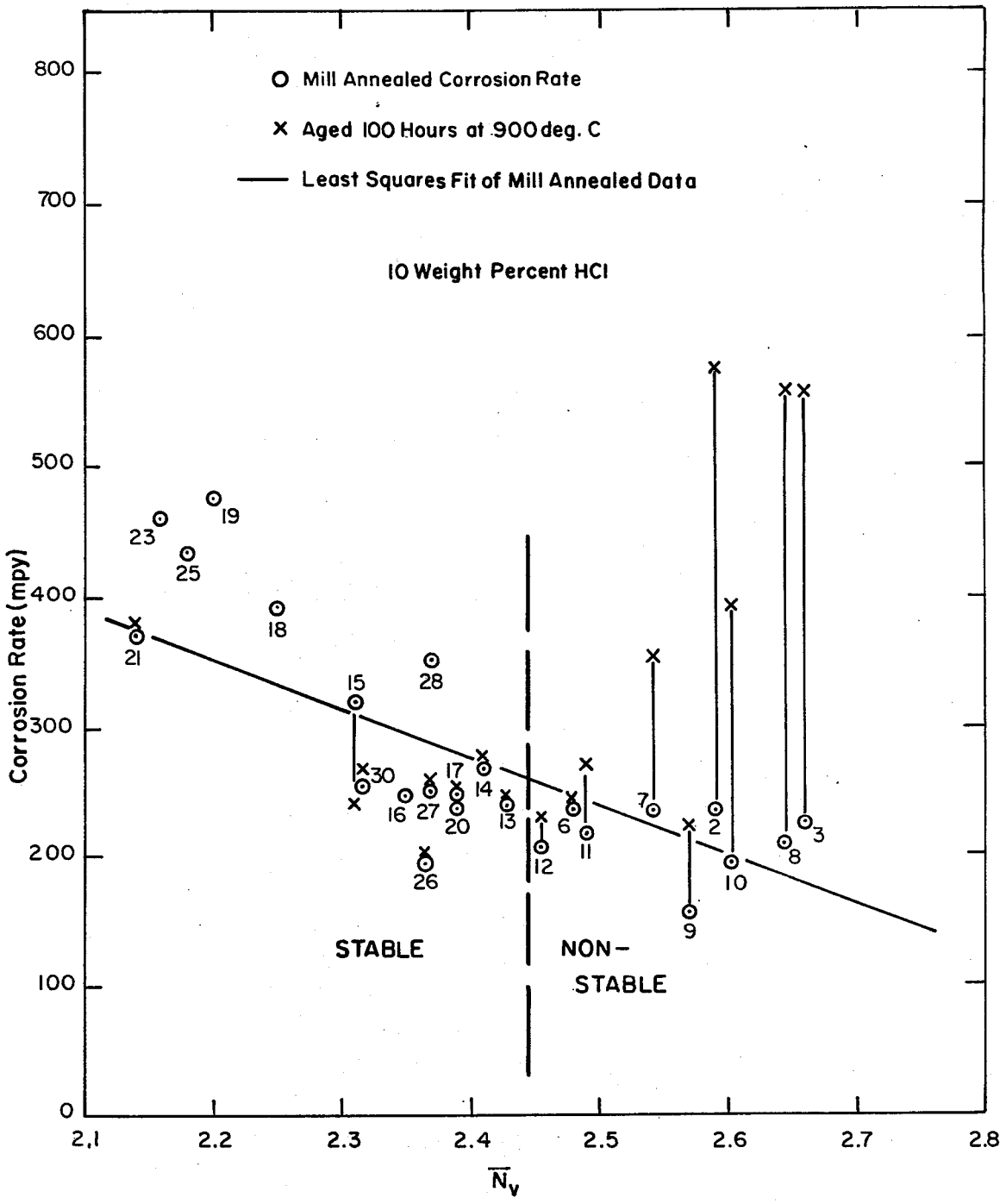

This application is a continuation of our copending application Ser. No. 329,974, filed Feb. 6, 1973, abandoned.

This invention relates to nickel-base alloys and more particularly to Ni—Cr—Mo— alloys. The alloys of the present invention possess good high temperature structural stability and thus improved corrosion resistance and mechanical properties in both the welded and thermally aged condition.

Fabricated and welded chemical process equipment of nickel-chromium-molybdenum alloys have been of importance to the chemical industry for severely corrosive environments where corrosion resistance is required. Historically these alloys were typified by HASTELLOY* alloy C (U.S. Pat. No. 1,836,317). Following welding or even very short aging treatments, solution annealing of alloy C was required to eliminate detrimental metallurgical phases that impaired the mechanical and corrosion properties. Modification of this class of alloys has occurred in recent years, U.S. Pat. No. 3,203,792, and Canadian Pat. No. 859,062, to provide improved metallurgical stability with respect to precipitation of carbides and intermetallic phases. Alloys within the scope of the present art, even though possessing improved stability, will precipitate both carbides and intermetallic phases upon aging within the temperature range of 650° to 1090° C which subsequently reduce the corrosion resistance and mechanical properties of the alloy.

T. M. Cabot Corportion

Within the scope of the chemical environments where alloys of the class described by the present art find application, numerous examples exist where both oxidizing and reducing solutions can cause serious intergranular corrosion of a sensitized (precipitated) microstructure. The sensitized microstructures can result from several sources: (i) exposure to temperatures in the sensitizing range (650° to 1090° C) during the operation of equipment whether it be for production of chemicals or as a pollution control device, (ii) thermomechanical processing procedures such as hot forming of process equipment components, (iii) stress-relief or normalizing heat treatments required for carbon steel components of a complex multi-material component, or (iv) use of newer high heat input and high deposition rate welding techniques such as electroslag welding.

There has remained, therefore, a need for alloys that successfully resist the precipitation of carbide and intermetallic phases while still providing the wide range of corrosion resistance to both oxidizing and reducing conditions as exhibited by the present nickel-chromium-molybdenum alloys in the solution annealed condition. The present invention satisfies that need to a greater extent than any alloy heretofore known.

The principal object of the present invention is to provide nickel-base alloys with excellent corrosion resistance to both oxidizing and reducing environments in the annealed, welded and thermally aged conditions. Another object is to provide such alloys that not only possess excellent corrosion resistance but which also have outstanding thermal stability and resistance to loss of mechanical properties as a result of structural changes during aging or thermo-mechanically forming.

It is a further object to provide solid solution nickel-base alloys which can be readily produced and fabricated and are homogeneous in the state of equilibrium.

Still other objects wil be obvious or will become apparent from the following description of the invention and various preferred embodiments thereof.

In accordance with the present invention, the above objectives and advantages are obtained by carefully controlling the composition of the nickel-base alloy within the broad range set forth in Table I hereinafter.

TABLE I

| Element | Range, Percent by Weight |
|---|---|
| Chromium | 12–18 |
| Molybdenum | 10–18 |
| Iron | 0–3 |
| Tungsten | 0–7 |
| Aluminum | <.5 |
| Carbon | .02 max. |
| Silicon | .08 max. |
| Cobalt | <2 |
| Manganese | <.5 |
| One of the group Titanium, Zirconium and Hafnium | up to 0.75 |
| One of the group Vanadium and Tantalum | up to 0.75 |
| Nickel and Incidental impurities | Balance |

In order, however, to maximize the benefits of this invention and to reduce the possibilities of falling outside the desired range, we prefer to maintain the composition within the narrower ranges of Table II which follows:

TABLE II

| Element | Range, Percent by Weight |
|---|---|
| Chromium | 14–17 |
| Molybdenum | 14–16 |
| Iron | <2 |
| Tungsten | 0.5 max. |
| Aluminum | <0.5 |
| Carbon | 0.01 max. |
| Silicon | 0.03 max. |
| Cobalt | <1 |
| Manganese | <0.5 |
| One of the group Titanium, Zirconium and Hafnium | up to 0.5 |
| One of the group Vanadium and Tantalum | up to 0.5 |
| Nickel and Incidental impurities | Balance |

The single preferred composition of this invention is:

| Element | Range, Percent by Weight |
|---|---|
| Chromium | about 16 |
| Molybdenum | 15 |
| Iron | <2 |
| Tungsten | 0.5 max. |
| Aluminum | <0.5 |
| Carbon | 0.01 max. |
| Silicon | 0.03 max. |
| Cobalt | <1 |
| Manganese | <0.5 |
| Titanium | up to 0.5 |
| Nickel and usual impurities | Balance |

It has been found, as a part of the present invention, and as a result of extensive investigation that with nickel-chromium-molybdenum alloys the composition must be carefully balanced to provide for the optimum stability and minimum corrosion rates. Upon aging within the temperature range of 650 to 1090° C, alloys as represented by the prior art precipitate inter- and intragranular carbide and intermetallic precipitates. X-ray diffraction analysis has shown the carbides to be of the $M_6C$ type with lattice parameters ($a_o$) = 10.8 to 11.2 A. The metallic portion of the carbide was observed to contain chromium, molybdenum, iron, tungsten, silicon, and nickel. The intermetallic precipitate was identified as having the same crystal structure as $Fe_7Mo_6$ which is rhombohedral/hexagonal ($D8_5$ type) belonging to space group $R\bar{3}M$. The chemical formulation of the intermetallic reduced to a compound was $(Ni,Fe,Co)_3(W,Mo,Cr)_2$. This is in agreement with the published information on $Fe_7Mo_6$ wherein the compound is chemically $Fe_3Mo_2$. Therefore, it was concluded that the intermetallic phase is a $(Ni,Fe,Co)_3(w,Mo,Cr)_2$ mu phase possessing mean lattice parameters of $a_o = 4.755$ A and $c_o = 25.664$ A. The formation of the compound was found to be controlled by diffusion of the reacting species since the kinetics of formation were parabolic and the activation energy was 62 kcal/mole which is in agreement with published activation energies for diffusion in nickel. These data in combination with the fact that the complex mu phase does not appear in the three component (Ni—Cr—Mo) phase diagram indicate that the precipitation response of the alloys is complex and control of all elements is required to insure stability.

The trigonal mu phase is representative of a class of intermetallic phases usually identified as topologically close packed (TCP) phases. For the purposes of the present invention, we have found that the formation of the detrimental TCP mu phase can be avoided by balancing the composition so as to provide a relatively low, atomically averaged electron vacancy concentration number, $\overline{N}v$. The value of $\overline{N}v$ required has been found to be about 2.40 when estimated by a simplified calculation procedure using the following equation: (I)

$$\overline{N}v = 0.61\,(a_{Ni}) + 1.71\,(a_{co}) + 2.66\,(a_{Fe}) + 3.66\,(a_{Mn}) + 4.66\,(a_{Cr}) + 5.66\,(a_{Ta+Nb+V}) + 6.66\,(a_{Zr+Ti+Si+Hf}) + 7.66\,(a_{Al}) + 8.66\,(a_{Mg}) + 9.66\,(a_{W+Mo})$$

where each "$a$" indicates the actual atomic fraction of the alloying elements indicated by the subscripts. When this calculation is carried out for each of the specific exemplary alloys of Table III, the following results are obtained (Table IV).

TABLE III

ALLOY COMPOSITIONS INVESTIGATED

| Alloy No. | Weight Percent | | | | | | | | | | |
|---|---|---|---|---|---|---|---|---|---|---|---|
| | Cr | W | Fe | C | Si | Co | Ni | Mn | V | Mo | Al |
| 1 | 16.11 | 3.66 | 6.46 | .014 | .03 | .92 | 55.94 | .46 | .09 | 16.01 | — |
| 2 | 15.50 | 3.74 | 5.92 | .008 | .01 | 1.83 | 57.70 | .40 | .04 | 15.78 | — |
| 3 | 16.38 | 3.70 | 5.98 | .004 | .01 | 1.08 | 55.83 | .34 | .21 | 16.25 | .22 |
| 4 | 16.10 | 3.65 | 6.15 | .011 | .06 | .85 | 56.30 | .42 | .11 | 16.00 | — |
| Prior 5 | 16.00 | 3.45 | 5.50 | .007 | .01 | .62 | 58.70 | .50 | .24 | 15.85 | .19 |
| Art 6 | 15.78 | .10 | 4.93 | .006 | .03 | 1.14 | 60.90 | .34 | .21 | 16.39 | .16 |
| 7 | 15.70 | 1.74 | 4.90 | .006 | .02 | 1.15 | 59.49 | .32 | .25 | 16.26 | .16 |
| 8 | 14.94 | 5.68 | 4.65 | .006 | .01 | .98 | 57.17 | .40 | .19 | 15.82 | .15 |
| 9 | 15.07 | 3.74 | .13 | .010 | <.01 | 1.00 | 62.02 | .35 | .20 | 17.22 | .21 |
| 10 | 15.66 | 3.63 | 3.28 | .003 | <.01 | 1.14 | 59.05 | .34 | .23 | 16.52 | .13 |
| 11 | 15.34 | 1.18 | 5.00 | .011 | .01 | 1.10 | 60.53 | .32 | .21 | 16.13 | .16 |
| 12 | 18.04 | <.25 | .18 | .006 | .02 | .01 | 64.80 | .42 | .07 | 15.94 | .26 |
| 13 | 15.39 | 2.51 | — | .001 | .01 | .05 | 64.10 | .43 | .21 | 15.88 | .22 |
| 14 | 17.16 | .02 | 1.31 | .004 | .03 | .65 | 63.94 | .31 | .03 | 15.30 | .15 |
| 15 | 13.84 | 2.78 | 3.20 | .007 | .02 | .05 | 65.05 | .36 | .01 | 14.53 | — |
| 16 | 15.88 | .11 | .07 | .006 | .02 | 1.06 | 64.80 | .44 | .24 | 16.13 | — |
| 17 | 16.69 | .35 | .01 | .001 | .01 | .04 | 65.80 | .44 | .21 | 15.80 | .22 |
| 18 | 15.20 | 3.31 | .01 | .001 | .01 | .04 | 67.10 | .41 | .18 | 12.93 | .21 |
| 19 | 15.09 | 6.60 | .01 | .001 | .01 | .05 | 67.50 | .42 | .17 | 10.05 | .22 |
| The 20 | 16.29 | .27 | .30 | .020 | .08 | 1.20 | 65.10 | .42 | .24 | 16.13 | — |
| Pre- 21 | 16.20 | 1.18 | .14 | .006 | .01 | .01 | 69.20 | .39 | .01 | 11.90 | .22 |
| sent 22 | 15.87 | 2.03 | .78 | .02 | .06 | .99 | 67.06 | .14 | .25 | 12.80 | — |
| In- 23 | 15.63 | 2.52 | 1.93 | .03 | .06 | 1.03 | 67.25 | .12 | .29 | 11.14 | — |
| ven- 24 | 15.93 | 2.84 | 2.83 | .02 | .05 | 1.03 | 66.64 | .10 | .26 | 10.30 | — |
| tion 25 | 14.08 | 2.76 | 3.05 | .006 | .06 | 1.06 | 64.60 | .40 | .26 | 12.03 | — |
| 26 | 15.76 | .10 | .30 | .006 | .02 | 1.09 | 65.55 | .38 | .26 | 16.39 | .13 |
| 27 | 17.53 | <.10 | 1.62 | .010 | .02 | .04 | 64.95 | .20 | .04 | 15.11 | .08 |
| 28 | 14.99 | 2.70 | 3.00 | .007 | .05 | 1.00 | 62.20 | .40 | .25 | 14.34 | — |
| 29 | 16.31 | .04 | .11 | .009 | .01 | .04 | 68.07 | .01 | .08 | 15.36 | .21 |
| 30 | 15.96 | .13 | .09 | .009 | .02 | .09 | 67.75 | .05 | .04 | 15.20 | .11 .51Ti |

TABLE IV

| Alloy Number | $\overline{N}v$ |
|---|---|
| 1 | 2.634 |
| 2 | 2.590 |
| 3 | 2.659 |
| 4 | 2.632 |
| 5 | 2.623 |
| 6 | 2.485 |
| 7 | 2.542 |
| 8 | 2.645 |
| 9 | 2.565 |
| 10 | 2.602 |
| 11 | 2.489 |
| 12 | 2.454 |
| 13 | 2.428 |
| 14 | 2.410 |
| 15 | 2.310 |
| 16 | 2.349 |
| 17 | 2.389 |
| 18 | 2.255 |
| 19 | 2.203 |
| 20 | 2.388 |
| 21 | 2.139 |
| 22 | 2.225 |
| 23 | 2.161 |
| 24 | 2.144 |
| 25 | 2.183 |
| 26 | 2.365 |
| 27 | 2.367 |
| 28 | 2.369 |
| 29 | 2.311 |
| 30 | 2.313 |

Figure 2:
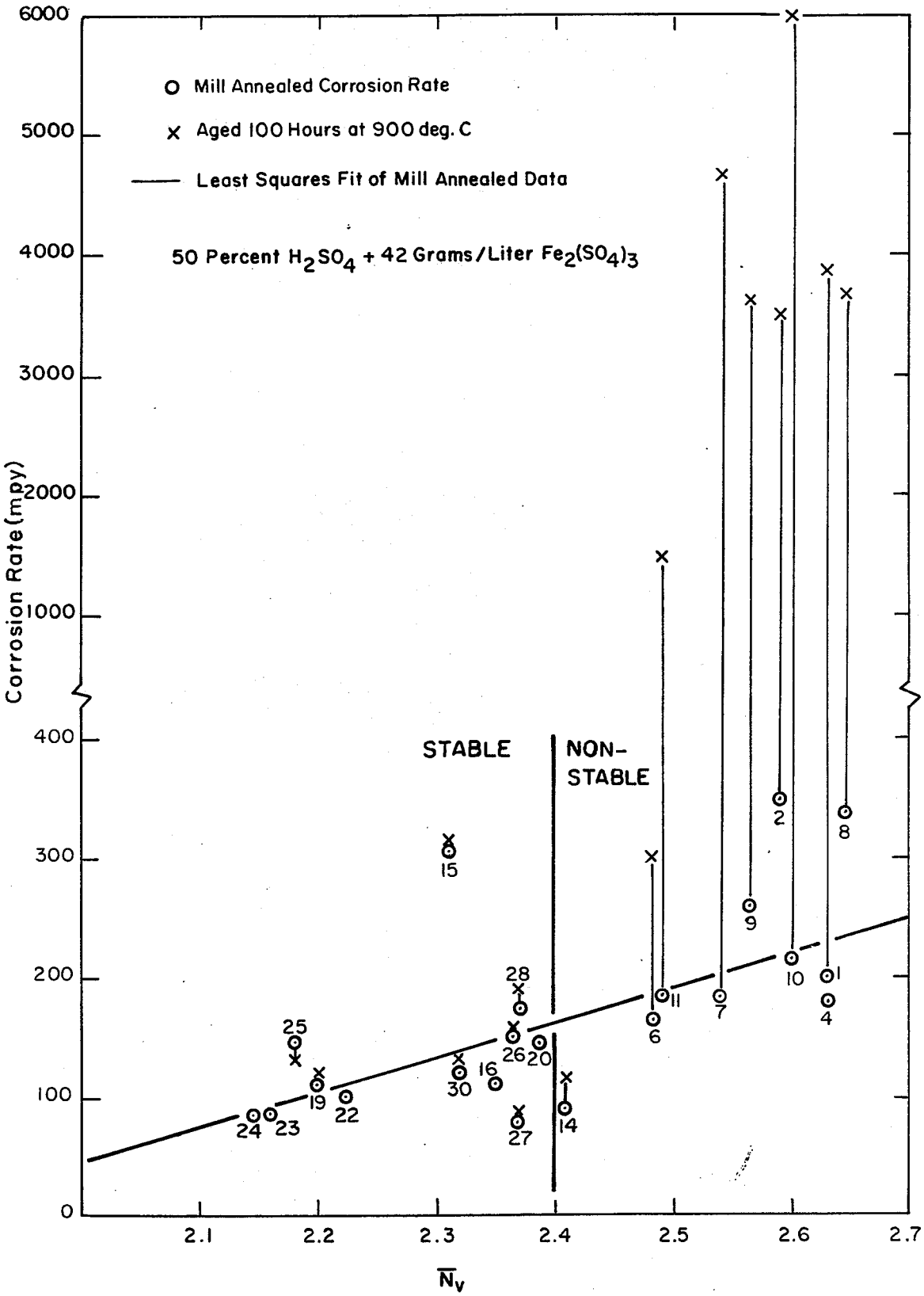

The critical nature of the $\overline{N}v$ value can be ascertained from an examination of FIGS. 1 and 2 which show the corrosion resistance in both the annealed and aged conditions as a function of $\overline{N}v$.

The steady state corrosion rates were determined for 28 alloys representing the prior art and this invention whose compositions are shown in Table III above. These corrosion rates were determined in the following manner:

1. Prepare specimens about 1-inch by 2 inches in size.
2. Grind all surfaces to a 120 grit finish and degrease in trichloroethane.

3. Measure exact surface area ($cm^2$) and weight (grams) of each specimen.
4. Expose specimens to a boiling solution of either 10 weight percent HCl or 50 weight percent $H_2SO_4$ + 42 grams per liter $Fe_2(SO_4)_3$ with balance double distilled water for 24 hours.
5. Reweigh each specimen and convert the weight loss during exposure to an average metal loss as expressed in mils penetration per year (mpy).

The corrosion rates for 22 solution annealed materials in a boiling 10 w/o HCl solution have been plotted in FIG. 1 and show a decreasing corrosion rate with increasing $\overline{Nv}$. The least squares fit for these data have a negative slope value of −369 and an intercept of 1165 within the $\overline{Nv}$ range of 2.1 to 2.7. Increasing the $\overline{Nv}$ of the alloy would therefore appear to be desirable for this reducing system. However, when the corrosion data are plotted for coupons that were aged 100 hours at 900° C prior to corrosion testing, a significant decrease in corrosion resistance is observed for those alloys with $\overline{Nv}$ in excess of about 2.44 This loss in corrosion resistance has been correlated with the formation of carbides and intermetallic phases which deplete the matrix in those elements that are responsive for the corrosion resistance of the alloy. It has been learned that in these reducing solutions the precipitating particles are not attacked but it is the adjacent molybdenum depleted matrix material where accelerated attack is manifested.

When the data for the oxidizing sulfuric acid-ferric sulfate solution hereinafter referred to as the ferric sulfate test, are plotted versus $\overline{Nv}$ (FIG. 2), the opposite trend in corrosion rate is observed. Within the $\overline{Nv}$ range of 2.1 to 2.7 the least squares line has a positive slope of 286 and an intercept of −526. Thus in direct contradiction with the reducing data, the best corrosion rates are observed for low $\overline{Nv}$ alloys. A similar but more drastic loss in corrosion properties is, however, observed for those alloys with $\overline{Nv}$'s in excess of about 2.4 following the aging treatment. This oxidizing test has been demonstrated to be more sensitive to the presence of precipitate because the precipitates are directly and preferentially attacked by the solution. For example, consider alloy 14 which by quantitative metallography was shown to have 2 to 3 volume percent of precipitate. In the boiling hydrochloric acid test, the corrosion rates were 268 and 276 mpy for the annealed and aged samples, respectively, or a 3 percent increase. In the ferric sulfate test, the corrosion rates were 90 and 114 for the annealed and aged samples, respectively, or a 27 percent increase. Contrast those data with the data for alloy 2 which contained approximately 10 volume percent precipitate. In boiling HCl the corrosion rates were 236 and 575 mpy for the annealed and aged samples, respectively, or a 144 percent increase. The annealed and aged corrosion rates were 350 and 3550 mpy respectively in the ferric sulfate test or a 1000% increase. The critical $\overline{Nv}$ value as determined by metallography and corrosion testing has been found, therefore, to be about 2.4; therefore, alloys 1 through 13 of Table III represent alloys outside the present invention.

Because of the nature of the $\overline{Nv}$ calculation, a large number of alloys exist within the identified stable range of 2.1 to 2.39 with widely varying corrosion resistances. Balancing of the elements Cr, Mo, W, and Fe to provide maximum corrosion resistance, coupled with metallurgical stability, required information on the effect of these elements on the corrosion resistance of solid solutioned single phase alloys. The same solution annealed corrosion data utilized in FIGS. 1 and 2 were analyzed using multiple regression analysis to yield the following relationships:

(II) Hydrochloric Acid

C.R. (mpy) = 1170–13.3 (% Cr) −7.3 (% W) 2.4 (% Fe) −45.1 (% Mo)

(III) Ferric Sulfate Test

C.R. (mpy) = 142 23.9 (% Cr) + 26.7 (% W) + 3.96 (% Fe) + 22.6 (% Mo)

The composition of the alloys identified by the present invention is, therefore, derived by maximizing the value of $\overline{Nv}$ from equation I within the range of 2.1 to 2.39 while minimizing the values of corrosion rate (C.R.) from equations II and III. For example, consider the alloys 26, 27, and 28 which exhibit $\overline{Nv}$ values of 2.365, 2.367 and 2.369 respectively. The hydrochloric acid data range from 195 mpy to 350 mpy and the ferric sulfate test data range from 75 to 150 mpy. Thus, the composition must be carefully balanced since from equations II and III the effects of molybdenum are exactly opposite in the two solutions.

Figure 3:
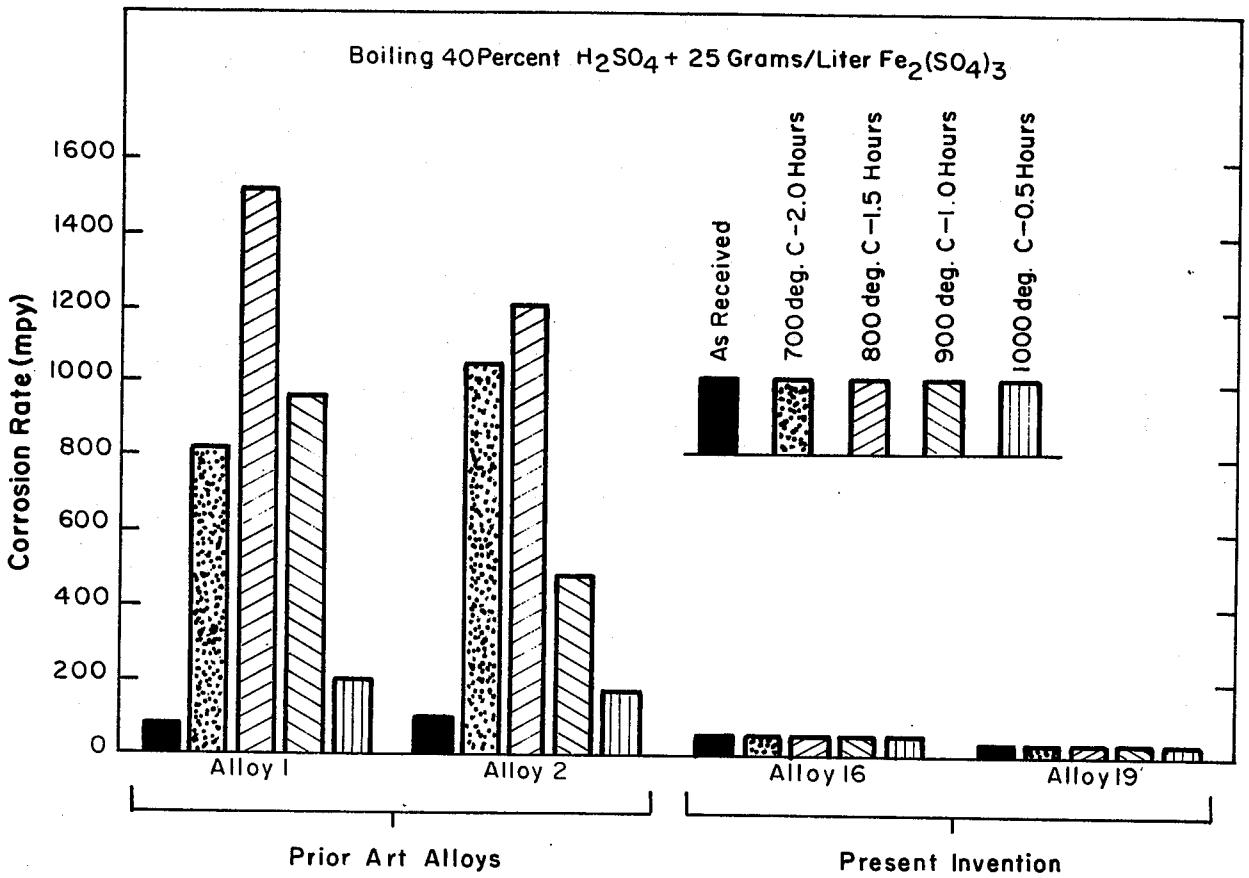
Figure 4:
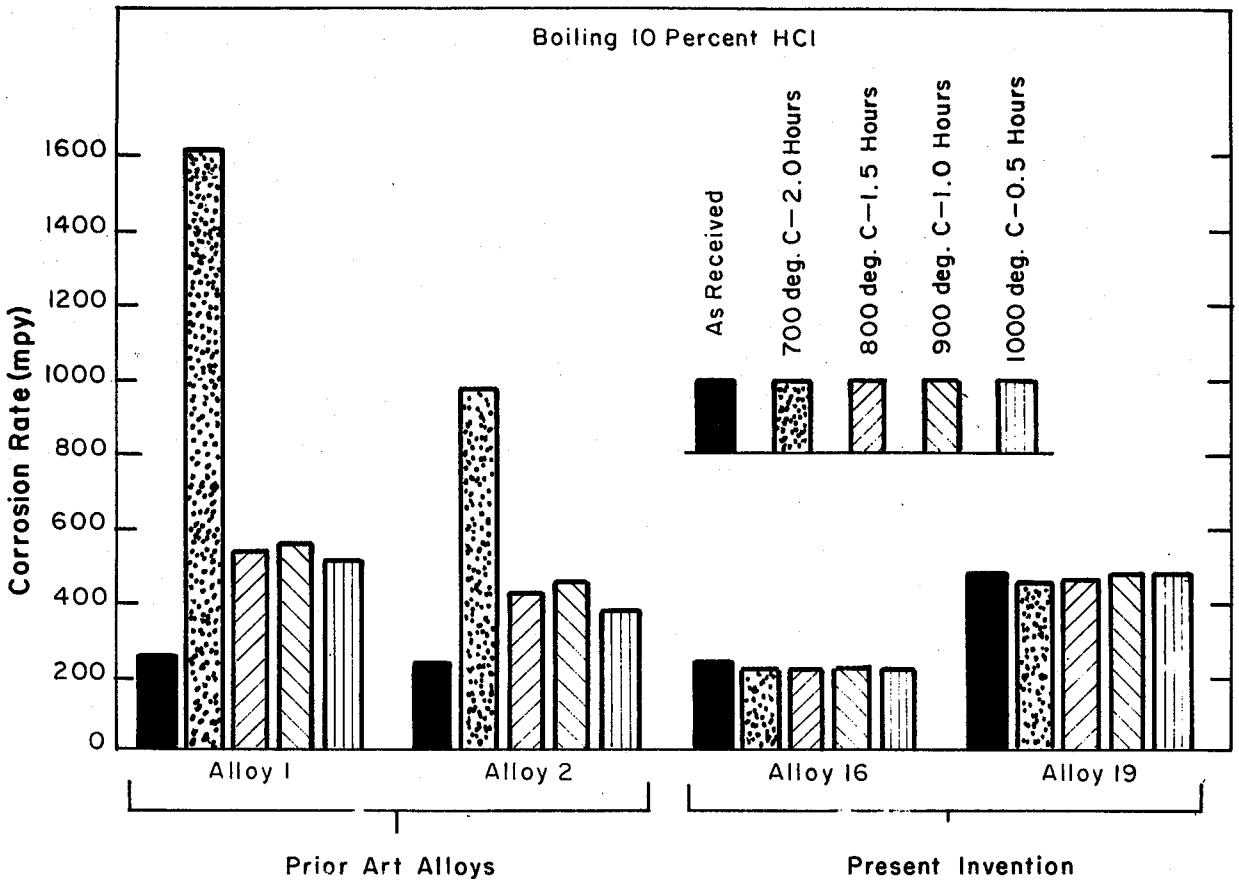

As a further example of the degree of stability attained and the optimization of corrosion resistance through the practice of this invention, four alloys were corrosion tested after various aging treatments as shown in FIGS. 3 and 4. Alloys 1 and 2, representing prior art, show considerable loss in corrosion resistance following aging at temperatures of 700°, 800°, 900° and 1000° C in both the hydrochloric acid and the ferric sulfate tests. Alloys 16 and 19, representative of this invention, had uniform rates in all aged conditions and in both solutions.

Figure 5:
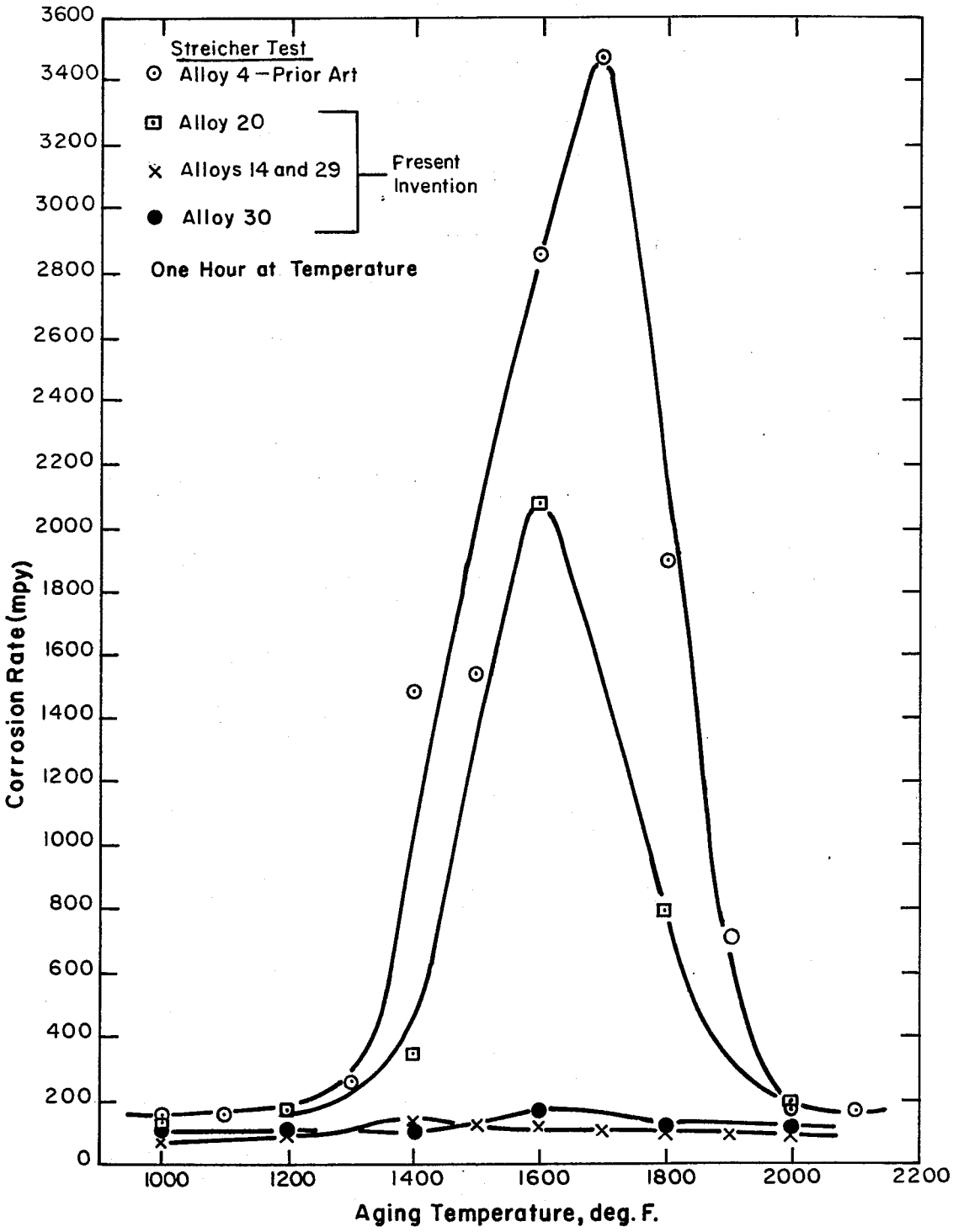
Figure 6:
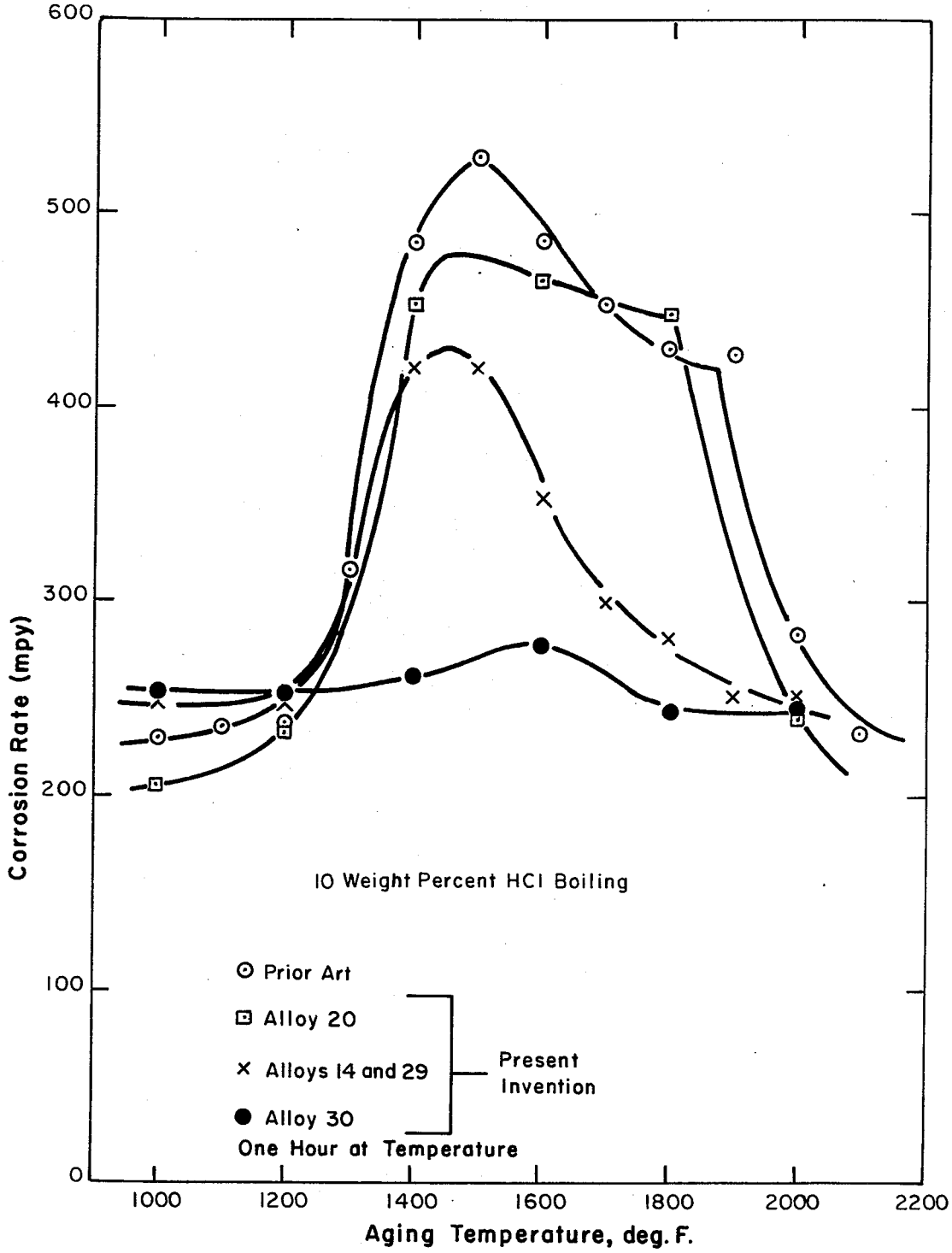

The ability of an alloy to avoid the precipitation of carbides when aged for short times at low temperatures has been amply demonstrated in the open literature to be a function of the total interstitial element content. Because of practical limitations in melting it is impossible to remove all interstitial elements and the alloys of the invention can precipitate carbides upon aging for short times in the 650°–1090° C range. The presence of said carbides can lower the corrosion resistance slightly as shown in FIGS. 5 and 6. By eliminating the precipitation of the intermetallic phase the corrosion rate increase due to aging is significantly reduced. However it is obvious that carbides do have a detrimental effect. The small amount of carbide present in alloys 14 and 29, which represent 10,000 lb. production heats, causes some loss in properties in the hydrochloric acid solution.

To minimize this effect a small amount of titanium was added to alloy 30 to combine with nitrogen and carbon that might be present in solution in the alloy. Titanium is particularly effective because of its low atomic weight but equal amounts of any of the refractory elements such as zirconium, or hafnium would be expected to perform the same function as long as they are factored into the $\overline{Nv}$ program. Similarly vanadium and tantalum may be present for their known advantages so long as they are properly factored into the $\overline{Nv}$ program. As shown in FIGS. 5 and 6 the addition of titanium has reduced the loss in properties to a minimum. The improvement in properties exhibited by alloy 30 over alloys of the prior art is most clearly demonstrated by corrosion testing for repeated 24 hours periods. Data generated for alloys 5, 20 and 30 in both the ferric sulfate test and hydrochloric acid test are presented in Table V. These data demonstrate that although some minimal loss in corrosion properties does occur, the corrosion rates of alloys of the present invention remain more stable with time. Table V is as follows:

TABLE V

Effect of Aging on Corrosion Rate

| Sample Aged for 1 hour at temperature | Alloy No. 5 Prior Art 1 | 2 | 3 | 4 | 5 | Alloy No. 20 Present Invention 1 | 2 | 3 | 4 | 5 | Alloy No. 30 Present Invention 1 | 2 | 3 | 4 | 5 |
|---|---|---|---|---|---|---|---|---|---|---|---|---|---|---|---|
| Corrosion Rate in Ferric Sulfate Test (mpy)*[a] | | | | | | | | | | | | | | | |
| 1000° F | 214 | 240 | 271 | 277 | 280 | 143 | 128 | 128 | 129 | 130 | 102 | 89 | 85 | 97 | 97 |
| 1200° F | 222 | 294 | 299 | 305 | 330 | 182 | 242 | 287 | 270 | 300 | 104 | 88 | 85 | 96 | 96 |
| 1400° F | 2065 | 2897 | nd[b] | nd | nd | 338 | 1069 | nd | nd | nd | 114 | 106 | 118 | 135 | 140 |
| 1600° F | 2551 | 3472 | nd | nd | nd | 2080 | 4965 | nd | nd | nd | 179 | 383 | 536 | 644 | 647 |
| 1800° F | 961 | 1478 | nd | nd | nd | 800 | 2120 | nd | nd | nd | 115 | 92 | 102 | 125 | 132 |
| 2000° F | 398 | 705 | 798 | 756 | 781 | 187 | 272 | 307 | 518 | 630 | 118 | 94 | 90 | 100 | 102 |
| Corrosion Rates in Hydrochloric Acid (mpy) | | | | | | | | | | | | | | | |
| 1000° F | 262 | 240 | 248 | 240 | 247 | 202 | 190 | 192 | 196 | 202 | 251 | 221 | 220 | 223 | 227 |
| 1200° F | 307 | 344 | 383 | 385 | 375 | 242 | 267 | 339 | 378 | 376 | 251 | 224 | 227 | 232 | 230 |
| 1400° F | 1051 | 1598 | nd | nd | nd | 453 | 767 | nd | nd | nd | 265 | 239 | 262 | 261 | 280 |
| 1600° F | 596 | 729 | nd | nd | nd | 464 | 1038 | nd | nd | nd | 282 | 284 | 316 | 315 | 340 |
| 1800° F | 651 | 820 | nd | nd | nd | 460 | 1078 | nd | nd | nd | 245 | 227 | 244 | 252 | 259 |
| 2000° F | 560 | 834 | 851 | 870 | 891 | 243 | 285 | 413 | 446 | 510 | 244 | 221 | 222 | 228 | 225 |

*[a]Each number rate represents the average of two coupons
[b]Not determined because of excessive grain dropping As melting and refining advancements are made that enable the consistent melting of this class of alloys to very low total interstitial contents, the titanium content can be reduced or removed completely.

Figure 7:
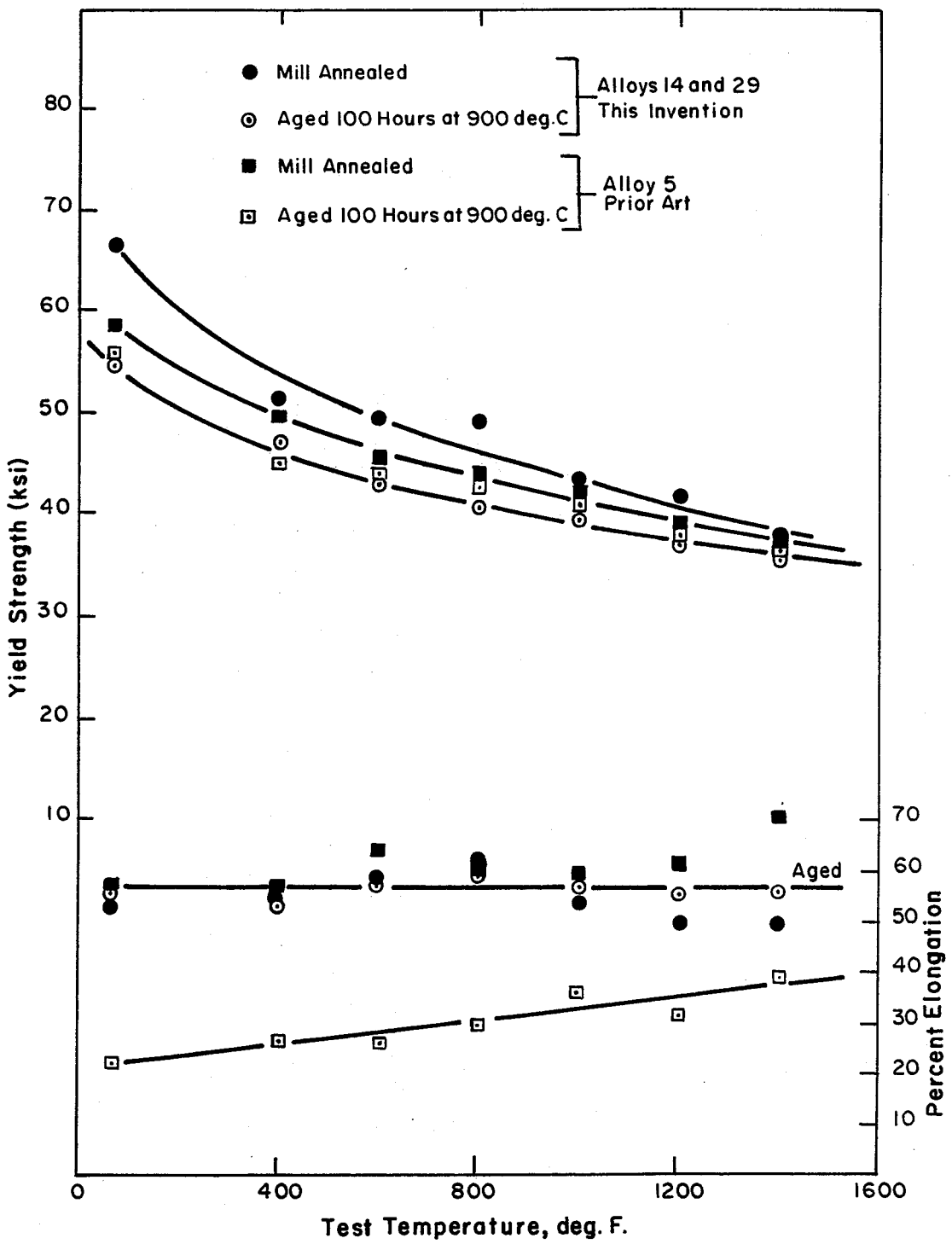

The metallurgical stability of the alloys of this invention also provide for improved mechanical properties in the aged condition. The tensile testing was performed at various temperatures in the standard manner using either annealed specimens that had merely been solution heat treated for 30 minutes at 2050° F followed by rapid air cooling or other specimens which had also subsequently been aged at 900° C for 100 hours and then air cooled. The results of such tests are presented in FIG. 7. The data in this figure show that a typical alloy of this invention has adequate engineering strength at temperatures below 1400° F and was comparable to prior art alloys such as alloy 5. More importantly, the data demonstrate that upon aging for 100 hours at 900° C the ductility of alloy 5 has dropped drastically over the same temperature testing range whereas the alloy representing this invention showed no ductility loss.

The foregoing specification and the drawings illustrate certain preferred embodiments and practices of this invention. It will be understood by men skilled in the art that this invention may be otherwise embodied and practiced within the scope of the following claims:

We claim:

1. A nickel base alloy having unusual corrosion resistance to both oxidizing and reducing environments in all of the annealed, welded and thermally aged conditions and consisting essentially by weight of about 12% to 18% chromium, about 10% to 18% molybdenum, about 0 to 3% iron, about 0 to 7% tungsten, less than 0.5% aluminum, 0.02 max. carbon, 0.08 max. silicon, less than 2% cobalt, up to 0.75% of a member from the group consisting of titanium, zirconium, and hafnium, up to 0.75% of a member from the group consisting of vanadium and tantalum and the balance nickel with usual impurities in ordinary amounts, said composition being adjusted so that the atomically averaged electron vacancy concentration number, $\overline{N}v$, is in the range about 2.1 to about 2.4, as calculated from the equation $$\overline{N}v = 0.61\,(a_{Ni}) + 1.71\,(a_{Co}) + 2.66\,(a_{Fe}) + 3.66\,(a_{Mn}) + 4.66\,(a_{Cr}) + 5.66\,(a_{Ta+Nb+V}) + 6.66\,(a_{Zr+Ti+Si+Hf}) + 7.66\,(a_{Al}) + 8.66\,(a_{Mg}) + 9.66\,(a_{W+MO})$$

where each "*a*" indicates the actual atomic fraction of the alloying elements indicated by the subscripts.

2. A nickel base alloy as claimed in claim 1 having a balanced relationship of the elements Cr, Mo, Fe and W to provide in the annealed condition a corrosion resistance factor (mpy) in the range 200 to 300 in hydrochloric acid and in the range 75 to 150 in the ferric sulfate test.

3. A nickel base alloy as claimed in claim 1 having a balanced relationship of the elements Cr, Mo, Fe and W to provide in the annealed condition a corrosion resistance factor (mpy) in the range 200 to 300 in hydrochloric acid.

4. A nickel base alloy as claimed in claim 1 having a balanced relationship of the elements Cr, Mo, Fe and W to provide in the annealed condition a corrosion resistance factor (mpy) in the range 75 to 150 in the ferric sulfate test.

5. A nickel base alloy as claimed in claim 1 having the composite consisting essentially of:

| | |
|---|---|
| Chromium | about 14% to about 17% |
| Molybdenum | about 14% to about 16% |
| Iron | <2% |
| Tungsten | 0.5% max. |
| Aluminum | <0.5% |
| Carbon | 0.01% max. |
| Silicon | 0.03% max. |
| Cobalt | <1% |
| Manganese | <0.5% |
| Titanium | up to 0.5% |
| Nickel and incidental impurities. | Balance |

6. A nickel base alloy as claimed in claim 5 having a balanced relationship of the elements Cr, Mo, Fe and W to provide in the annealed condition a corrosion resistance factor (mpy) in the range 200 to 300 in hydrochloric acid and in the range 75 to 150 in the ferric sulfate test.

7. A nickel base alloy as claimed in claim 5 having a balanced relationship of the elements Cr, Mo, Fe and W to provide in the annealed condition a corrosion resistance factor (mpy) in the range 200 to 300 in hydrochloric acid.

8. A nickel base alloy as claimed in claim 5 having a balanced relationship of the elements Cr, Mo, Fe and W to provide in the annealed condition a corrosion resistance factor (mpy) in the range 75 to 150 in the ferric sulfate test.

9. A nickel base alloy as claimed in claim 1 having a composition consisting essentially of:

| | |
|---|---|
| Chromium | about 16% |
| Molybdenum | about 15% |
| Iron | <2% |
| Tungsten | 0.5% max. |
| Aluminum | <0.5% |
| Carbon | 0.01% max. |
| Silicon | 0.03% max. |
| Cobalt | <1% |
| Manganese | <0.5% |
| Titanium | up to 0.5% |
| Nickel with usual properties. | Balance |

10. A fabricated welded article characterized by unusual corrosion resistance to both oxidizing and reducing environments and made from a nickel base alloy consisting essentially of:

| | |
|---|---|
| Chromium | about 14% to about 17% |
| Molybdenum | about 14% to about 16% |
| Iron | <2% |
| Tungsten | 0.5% max. |
| Aluminum | <0.5% |
| Carbon | 0.01% max. |
| Silicon | 0.03% max. |
| Cobalt | <1% |
| Manganese | <0.5% |
| Titanium | up to 0.5% |
| Nickel and incidental impurities | Balance |

said composition being adjusted so that the atomically averaged electron vacancy concentration number, $\overline{N}v$, is in the range about 2.1 to 2.4, as calculated from the equation $$\overline{N}v = 0.61\,(a_{Ni}) + 1.71\,(a_{Co}) + 2.66\,(a_{Fe}) + 3.66\,(a_{Mn}) + 4.66\,(a_{Cr}) + 5.66\,(_{Ta+Nb+V}) + 6.66\,(a_{Zr+Ti+Si+Hf}) + 7.66\,(a_{Al}) + 8.66\,(a_{Mg}) + 9.66\,(a_{W+Mo})$$

where each "$a$" indicates the actual atomic fraction of the alloying elements indicated by the subscripts.

11. A nickel base alloy as claimed in claim 10 having a balanced relationship of the elements Cr, Mo, Fe and W to provide in the annealed condition a corrosion resistance factor (mpy) in the range 200 to 300 in hydrochloric acid and in the range 75 to 150 in the ferric sulfate test.

12. A fabricated welded article as claimed in claim 10 made from an alloy consisting essentially of:

| | |
|---|---|
| Chromium | about 16% |
| Molybdenum | about 15% |
| Iron | <2% |
| Tungsten | 0.5% max. |
| Aluminum | <0.5% |
| Carbon | 0.01% max. |
| Silicon | 0.03% max. |
| Cobalt | <1% |
| Manganese | <0.5% |
| Titanium | up to 0.5% |
| Nickel and incidental impurities | Balance |

and wherein the atomically averaged electron vacancy concentration number, $\overline{N}v$, is in the range about 2.1 to 2.4, as calculated from the equation $$\overline{N}v = 0.61\,(a_{Ni}) + 1.71\,(a_{co}) + 2.66\,(a_{Fe}) + 3.66\,(a_{Mn}) + 4.66\,(a_{Cr}) + 5.66\,(a_{Ta+Nb+V}) + 6.66\,(a_{Zr+Ti+Si+Hf}) + 7.66\,(a_{Al}) + 8.66\,(a_{Mg}) + 9.66\,(a_{W+Mo})$$

where each "$a$" indicates the actual atomic fraction of the alloying elements indicated by the subscripts.

* * * * *

UNITED STATES PATENT OFFICE

CERTIFICATE OF CORRECTION

Patent No. 4,080,201 Dated March 21, 1978

Inventor(s) Frank G. Hodge, Russell W. Kirchner and William L. Silence

It is certified that error appears in the above-identified patent and that said Letters Patent are hereby corrected as shown below:

Column 3, line 38, "$(w,Mo,Cr)_2$" should read --$(W,Mo,Cr)_2$--;

Column 4, in Table III, Alloy No. 2 under the Mn column which is ".40" should read --.49--;

Column 4, in Table III, Alloy No. 26 under the V column which is ".26" should read --.27--;

Column 5, line 21, after "2.44" insert --.--;

Column 5, line 24, "responsive" should read --responsible--;

Column 6, line 12, "23.9" should be -- -23.9 --; and

Claim 10, column 10, line 2, "$(_{Ta+Nb+V})$" should be --$(a_{Ta+Nb+V})$--.

Signed and Sealed this

Twelfth Day of September 1978

[SEAL]

Attest:

RUTH C. MASON
Attesting Officer

DONALD W. BANNER
Commissioner of Patents and Trademarks